US007721575B2

(12) United States Patent
Yokoyama

(10) Patent No.: US 7,721,575 B2
(45) Date of Patent: May 25, 2010

(54) SOCKS

(75) Inventor: Yoshiyuki Yokoyama, Kakogawa (JP)

(73) Assignee: Unival Co., Ltd., Kakogawa-shi (JP)

( * ) Notice: Subject to any disclaimer, the term of this patent is extended or adjusted under 35 U.S.C. 154(b) by 71 days.

(21) Appl. No.: 12/094,584

(22) PCT Filed: Feb. 3, 2006

(86) PCT No.: PCT/JP2006/301863

§ 371 (c)(1),
(2), (4) Date: Sep. 3, 2008

(87) PCT Pub. No.: WO2007/088634

PCT Pub. Date: Aug. 9, 2007

(65) Prior Publication Data

US 2009/0288451 A1 Nov. 26, 2009

(51) Int. Cl.
*D04B 9/46* (2006.01)

(52) U.S. Cl. ..... 66/185

(58) Field of Classification Search ..... 66/178 R, 66/182, 183, 184, 185, 186, 187; 2/239–242
See application file for complete search history.

(56) References Cited

U.S. PATENT DOCUMENTS

| | | | | |
|---|---|---|---|---|
| 2,219,235 | A * | 10/1940 | Morton | 2/239 |
| 4,015,448 | A * | 4/1977 | Knohl | 66/185 |
| 5,103,656 | A * | 4/1992 | Hanson, II | 66/185 |
| 5,983,402 | A * | 11/1999 | Fincher | 2/239 |
| 6,012,177 | A * | 1/2000 | Cortinovis | 2/239 |
| 6,336,227 | B1 * | 1/2002 | Liput et al. | 2/239 |
| 6,536,051 | B1 * | 3/2003 | Oh | 2/239 |
| 7,007,517 | B2 * | 3/2006 | Menzies | 66/185 |
| 7,562,541 | B2 * | 7/2009 | Hermanson et al. | 66/186 |

FOREIGN PATENT DOCUMENTS

| | | |
|---|---|---|
| JP | 57-147207 | 9/1982 |
| JP | 6-12408 | 2/1994 |
| JP | 3090737 | 10/2002 |
| JP | 3103680 | 6/2004 |

OTHER PUBLICATIONS

International Search Report for PCT/JP2006/301863, dated Mar. 1, 2006.

* cited by examiner

*Primary Examiner*—Danny Worrell
(74) *Attorney, Agent, or Firm*—Marshall, Gerstein & Borun LLP

(57) ABSTRACT

An object of the present invention is to provide a sock which offers a fit, and does not cause fatigue, blood congestion, or the like if worn for a long period of time. The sock has a length from a toe to at least an ankle, and is knitted from a knitting yarn. The sock has a base knit structure knitted at an inside half region of an arch part of the sole from an upper thread and under thread, and has an auxiliary thread further inserted together with the upper thread, so as to form a knitted part which is contracted and reduced in extensibility.

7 Claims, 4 Drawing Sheets

SOCKS

TECHNICAL FIELD

The present invention relates to socks, and more particularly, to socks that are excellent in the fit and suitable as socks for sports.

BACKGROUND ART

In recent years, as is the case with products in other areas, a variety of socks with peculiar characteristics suited for their specific uses have been provided. For example, for nursing care or sporting use, socks have been provided which are constructed to have characteristics fitted for nursing care or for sports. As a sock for the sports use, for example, a sock constructed to tighten the periphery of an ankle of a foot in the character 8-like manner and imparted with a supporter effect (patent document 1), and a sock constructed to simply tighten an ankle or a region in front of the ankle in a ring-like manner and imparted with a supporter effect (patent document 2) have been proposed.

In the case of these supporter-effect imparted socks, a sense of fit is certainly present at the beginning when the socks are worn, and a feeling of the foot being lightened is obtained. Such a feeling enhances the concentration of the sock wearer, leading to a fine play in the sport. This is in common with a major player's sticking to goods which he has been accustomed to and is fond of.

Patent document 1: Japanese Utility Model Registration Publication No. 3090737

Patent document 2: Japanese Utility Model Application Unexamined Publication No. 57-147207

DISCLOSURE OF THE INVENTION

Problem to be Solved by the Invention

However, if a sock with a supporter effect is worn for a long period of time (for example, at least 3 to 4 hours in the case of a soccer game inclusive of a warm-up, 3 to 4 hours in the case of a baseball game, and 3 to 6 hours in the case of a tennis game), the foot is tightened in a ring-like manner during that period of time. In this case, blood congestion takes place in the tightened foot, resulting in the foot getting even more tired. Especially, in the case of practice or practice matches of the sports, the period of time during which the sock is worn becomes even longer, often with the sock kept on for about 5 to 8 hours. In such a case, it is feared that trouble may be caused in health.

The present invention has been accomplished in view of these circumstances, and a primary object of the present invention is to provide a sock which offers a sense of fit, and which does not cause tiredness or blood congestion even when worn for a long period of time.

Means to Solve the Problem

The object of the present invention is attainable by a sock of the following construction.

A sock of the present invention is a sock having a length from a toe to at least an ankle and formed by knitting a knitting yarn, which is characterized in that it comprises a base knit structure knitted at least at an inside half region of a sole arch part of the sock from an upper thread and under thread; an auxiliary thread further inserted along with the upper thread; and a knitted part thus formed which is contracted and reduced in extensibility.

With the sock according to a first aspect of the present invention, because the auxiliary thread is inserted in the region along with the upper thread, the extensibility of the upper thread is reduced, and the knitted fabric becomes contracted, resulting in the stiffness (bending strength) of this knitted fabric increased. In other words, a knitted part contracted and reduced in extensibility is formed at the inside half region of the sole arch part of the sock, and this knitted part, due to the tensile force (contractile force) of the knitted part surrounding same, is caused to fit the inside half part of the arch part (inside arch part) of a foot. For this reason, even in the condition of the sock being worn, an inside longitudinal arch part is clearly formed, which helps the foot to efficiently keep the bodily balance (especially, front and back balance) during exercises. In addition, impact force may be effectively absorbed at the inside arch part of the foot. As a result, the foot becomes difficult to get tired, and the fatigue of the body is lessened, with the impact to the internal organs located on the upper side of the body and to the head being alleviated. Furthermore, in the case of this sock, because no squeeze is made on from the sole to instep in a circumferential manner, arteries, nerves, and the like of the sole are free of unnecessary compression. For this reason, blood congestion or the like is unlikely to occur, and the fatigue of a foot is also alleviated in this respect. With this sock, if worn with a sports shoe which has an inner shape that fits the inside half part of the arch part of a foot (e.g. basketball shoe, jogging shoe, or the like), the inside longitudinal arch is more securely formed. Consequently, the effect is obtained more prominently, and a sense of unity between the sock, the shoe included, and the foot is increased, thereby allowing the foot to be felt very light.

Furthermore, though sweat glands are concentrated in the arch part of a foot, especially in the inside half part of the arch part, because the knitted fabric which comes into contact with that part has, in addition to the under thread and upper thread, the auxiliary thread further inserted therein, the sock is increased in absorbency of sweat and gives no unpleasant feeling to the user for a long period of time. The sock is also preferable in this respect.

In the sock, if the auxiliary thread comprises a FTY (Filament Twist Yarn) having a core yarn and cover yarn, and the cover yarn comprises a polyester yarn or nylon yarn, the knitted fabric in the inside half region of the arch part becomes thick due to the high bulkiness of the FTY, thereby allowing sweat to be retained in the space between the cover yarn and the core yarn as well as by the absorbing capacity of sweat owned by the cover yarn and the core yarn themselves, with the result that the sweat at the sweat-glands abounding arch part is effectively absorbed. The structure is also preferable in this respect. Furthermore, if the auxiliary thread having a polyester yarn or nylon yarn is inserted in the inside half region of the sock arch part, by subjecting to heat setting treatment after completion of knitting, this region comes to have a high stiffness (bending strength) due to thermoplasticity owned by these yarns, thereby allowing this region to be further contracted and reduced in extensibility.

In the sock, if a rubber thread is further inserted as a knitting yarn for the inside half region of the sole arch part, the contractility of the knitted fabric in the inside half region is further increased so as to increase the fit. In addition, because the rubber thread is made up of an elastic core yarn and a cover yarn around same, the thickness of the knitted fabric in this region can be further increased, thereby further increasing the above-mentioned absorbing function of sweat. The structure is preferable in this respect.

In the sock, if the base knit structure at the arch part comprises ridge stitches (also referred to as "rubber stitches" or "rib stitches") or mesh stitches, it is preferable in that the contractility resulting from the knit structure is increased.

In the sock, if the thickness of the core yarn is from 25 deniers to 110 deniers, and the thickness of the cover yarn is from 5 deniers to 150 deniers, an increase is made in contractility of the knitted fabric, a reduction is made in extensibility, and smooth knitting is made possible. The structure is preferable in this respect.

In the sock, if at least one of the core yarn and cover yarn is a yarn different in color from that of the upper thread, a distinction between a left and right sock can securely be made, excluding an error in putting on a left and right sock. The structure is preferable in this respect.

In the sock, if, of a part extending circumferentially from a sole through the arch part to an instep part, a part that excludes the arch part comprises a knit structure of ridge stitch (also referred to as "rubber stitch" or "rib stitch"), mesh stitch, or plain stitch, an increase is made both in contractility and extensibility resulting from this knit structure, making it possible for the sock arch part to come into close contact with the foot arch part, and for the sock to be worn or taken off smoothly.

In the sock, if the under thread comprises an FTY, a structure may be realized in which, by subjecting to heat setting treatment after completion of the knitting, the region is further increased in contractility, and the knitted fabric in the region is further reduced in extensibility, so that the fit is further enhanced. In addition, the absorbency of sweat may further be increased.

Effect of the Invention

According to the thus constructed present invention, there is provided a sock which is suitable as a sporting sock, gives a sense of fit, and is unlikely to cause blood congestion or fatigue in the foot if worn for a long period of time.

DESCRIPTION OF SYMBOLS

A: Sock
1: Arch part
1*a*: Inside half region of arch part
1A: Rubber thread
1B: Under thread (FTY)
1C: Upper thread
1D: Auxiliary thread (FTY)
2: Toe part
3: Opening part
5: Inside surface contiguous to inside half region
5*u*: Lower part of inside surface contiguous to inside half region

BEST MODE FOR CARRYING OUT THE INVENTION

An embodiment of a sock according to the present invention will now be described in detail with reference to the drawings.

Figure 1:
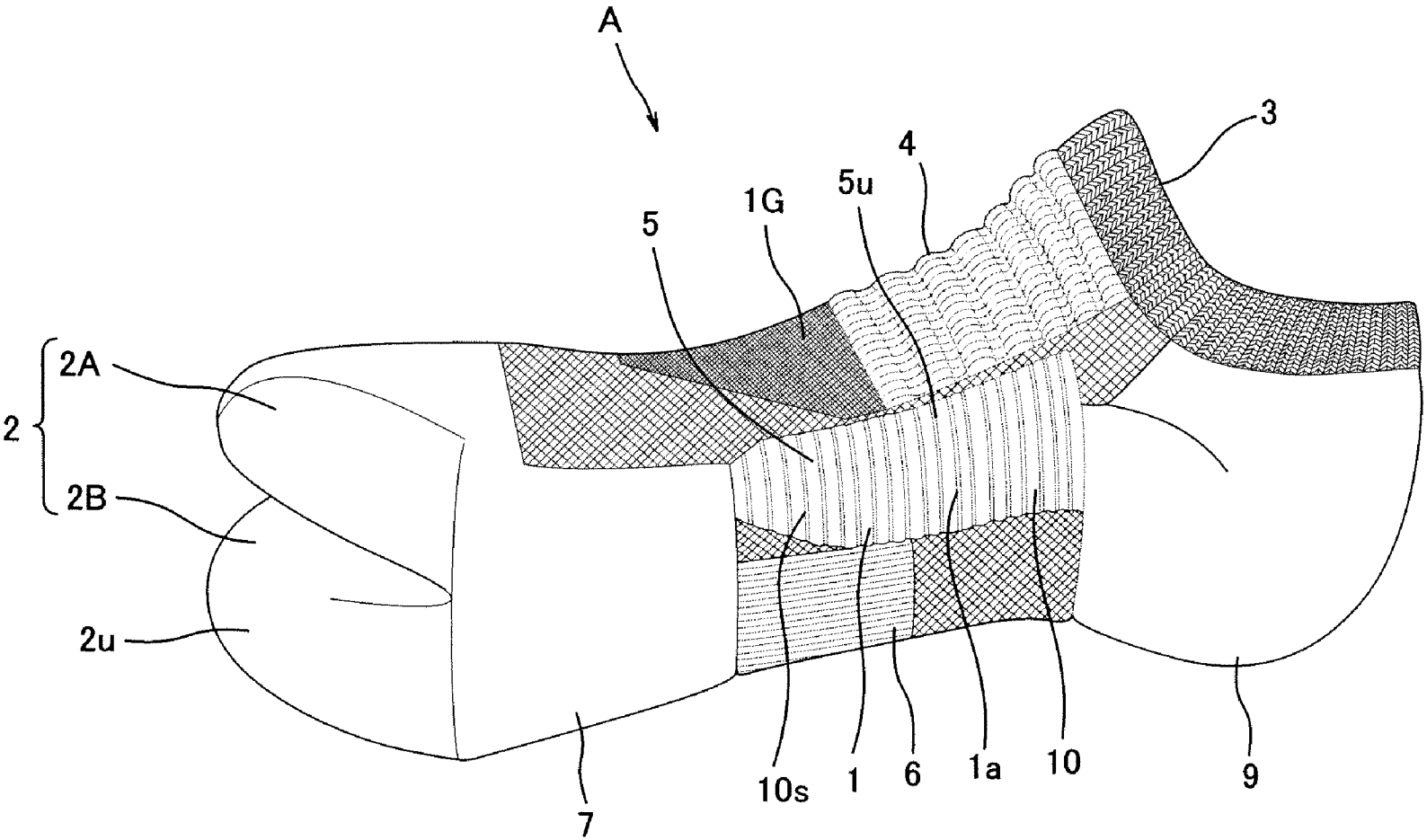
FIG. 1 is a perspective view of a sock according to one embodiment of the present invention, seen from a side somewhat to its bottom surface.
Figure 4:
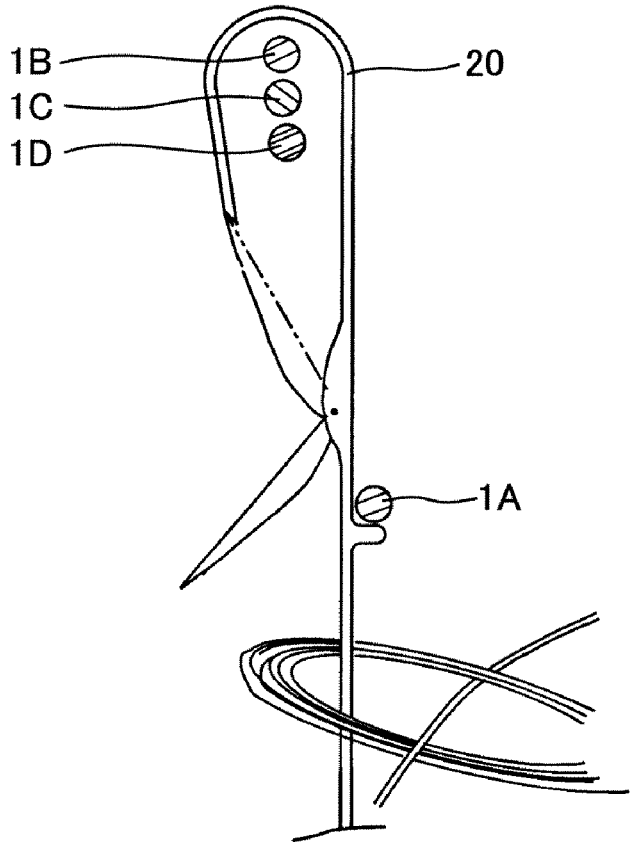
FIG. 4 is a partial enlarged view of a knitting needle part of a knitting machine, showing the order in which threads are inserted in the knitting needle.

In FIG. 1, A is a sock that is formed with its base knit structure woven from at least an under thread 1B and upper thread 1C as shown in FIG. 4. In the case of the sock A, a rubber thread 1A, in addition to the under thread 1B and upper thread 1C, is inserted into the knitted fabric at suitable sites as shown in FIG. 4.

The sock A has a so-called arch part 1 which comes into contact with the arch part of a human sole. The arch part 1 is generally called an "arch part" in the socks industry and the like.

Figure 3:
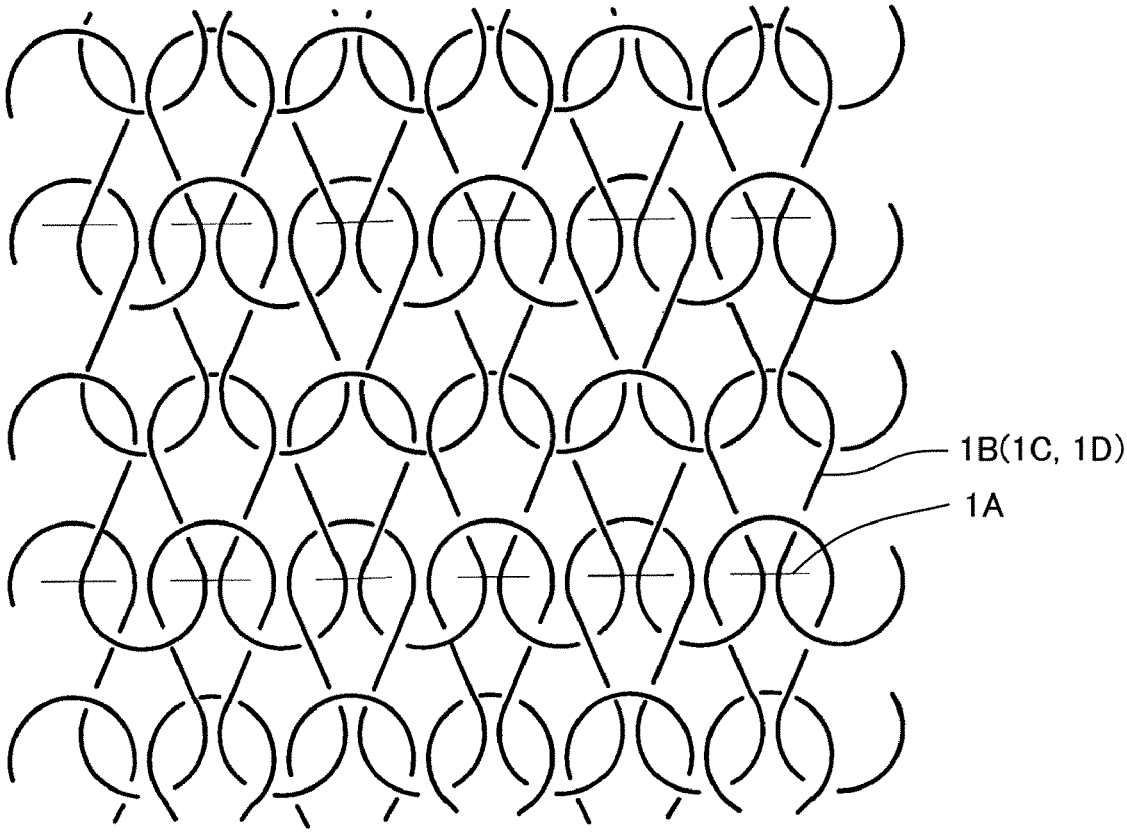
FIG. 3 is a partial enlarged view of the knitting (knit structure) of an inside half region of an arch part of the sock shown in FIG. 1, and of a side lower part contiguous thereto.

In the present sock A, a knitted fabric 10 (vid. FIG. 1) is woven at an inside half region 1*a* of the arch part 1 and at a lower part 5*u* of an inside surface 5 contiguous thereto, the knitted fabric 10 having, in addition to the under thread 1B, the upper thread 1C, and the rubber thread 1A, an FTY inserted as an auxiliary thread ID together with the upper thread 1C as shown in FIG. 4. The knitted fabric 10 in the present embodiment is knitted in a knit structure of 1×1 mesh, which is as shown in enlargement in FIG. 3. Incidentally, the thin line drawn horizontally in FIG. 3 indicates the rubber thread 1A which is inserted in alternate courses.

The insertion of each thread in the knitted fabric 10 is done, as shown in FIG. 4, in the order of the rubber thread 1A, under thread 1B, upper thread 1C, and auxiliary thread ID relative to a knitting needle 20.

Figure 2:
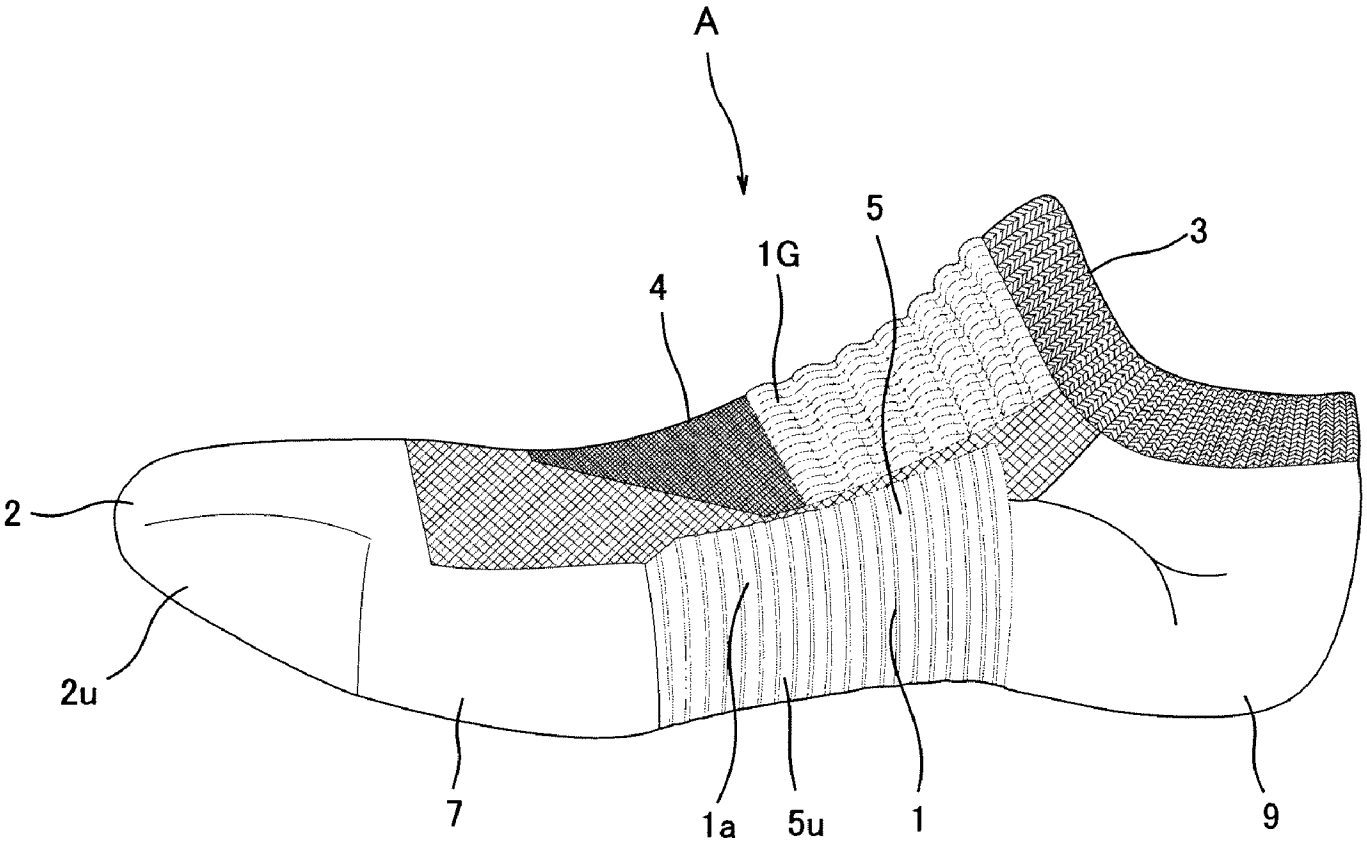
FIG. 2 is a side view of the sock shown in FIG. 1.

The rubber thread 1A and under thread 1B are exposed on the back side (not shown) of the knitted fabric 10, and the upper thread 1C and the auxiliary thread 1D are exposed on the front side 10*s* (vid. FIGS. 1 and 2) of the knitted fabric.

The rubber thread 1A is inserted in an extended condition (stretched condition) relative to the knitting needle 20, which contributes to making the knitted fabric 10 contracted and low in extensibility after it is knitted.

Furthermore, in this embodiment, the auxiliary thread 1D is not inserted in every course of the knitted fabric 10, but inserted in a repeated insertion pattern of 3 courses inserted and 2 courses not inserted. However, this pattern of insertion of the auxiliary thread 1D is merely an example, and it may be inserted so as to conform to the required contractile performance and extensible performance. Accordingly, the auxiliary thread 1D may be inserted in every course of the knitted fabric 10 according to need. Alternatively, the auxiliary thread 1D may be inserted in alternate courses, in a repeated pattern of alternate insertion and non-insertion. Alternatively, any other pattern such as that in which the auxiliary thread 1D is inserted in alternate pairs of courses may be adopted.

Furthermore, in the sock A of this embodiment, of a ring-like part ranging circumferentially from the sole through the arch part 1 to an instep part, a part 1G that excludes the inside half region 1*a* of the arch part 1 and the lower part 5*u* of the inside surface 5 contiguous thereto is desirably formed in a knit structure of rich elasticity. For example, in the case of this embodiment, of the part 1G, an instep part 4 of the sock A is knitted by mesh stitch or plain stitch using the under thread 1B, upper thread 1C, and rubber thread 1A, while a part 6 other than the instep part 4 is knitted by plain stitch using the under thread 1B and upper thread 1C. Part of the knit structure of the part 1G may be in ridge stitch. In knitting this part, it is desirable that the rubber thread 1A be inlaid without being extended so as to impart a large elasticity.

However, the knit structure for the part 1G is not restricted to this embodiment, and any suitable knit structure other than that mentioned above is also employable. For example, as the simplest structure employable, all of the part 1G may be knitted from the under thread 1B, upper thread 1C, and rubber thread 1A by ridge stitch, or may be made by mesh stitch or plain stitch.

In the case of this embodiment, the fact that the part 1G is knitted in the knit structure which gives a large elasticity as mentioned above, contributes to pulling the knitted fabric 10 part made up of the region 1*a* and the part 5*u* to the surface of a foot and fitting of the knitted fabric 10 part to the arch part of a foot.

Incidentally, in the case of the sock A of this embodiment, a part 7 which adjoins a toe part 2 and a toe part 2*u* of the sole and is located to a heel part 9 side, is knitted by ridge stitch, and is formed on the back side of the sock A with a pile.

Furthermore, the toe part 2 is bifurcated, in other words, consists of a pouched part 2A for receiving the big toe, and a pouched part 2B for the other toes. A sock of this type is generally called a two-toed sock.

However, the toe part of the sock A is not restricted to such a bifurcated one, and the sock may of course be made into a sock of the type having, like an ordinary sock, a single pouch for receiving all the toes, that is, a sock of the very common type. Alternatively, it may be made into a sock of the type having 5 pouched parts for receiving 5 toes separately (five toed sock).

Furthermore, an opening part 3 that forms the wearing mouth of the sock A is knitted by ridge stitch using the under thread 1B and upper thread 1C over a predetermined number of courses, for example 15 courses in this embodiment, with the rubber thread 1A inserted for each course in the ridge stitch as a weft. With such a structure, the opening part 3 is expanded widely to thereby allow the sock A to be easily put on and off, and the sock is prevented from slipping down.

An FTY is used for the under thread 1B in this embodiment.

Furthermore, a plurality of single yarns (3 in this embodiment) without being twisted are used as the upper thread 1 in this embodiment. However, as the upper thread 1, a twine such as a ply yarn (thread of 2 single yarns twisted), three folded yarn (thread of 3 single yarns twisted), or a quadruplex yarn (thread of 4 single yarns twisted) may be used. In the case where the twine such as the ply yarn, three folded yarn or quadruplex yarn is used as the upper thread 1, the knitted fabric can have firmness at the surface.

The rubber thread 1A used is of the type generally used as a knitting yarn for socks which is made up of a linear rubber disposed at the core, and a cover yarn covering the periphery of same. The rubber thread 1A is preferably a thread of thickness of 100 to 1000 deniers, and more preferably a thread of 300 to 600 deniers, and a thread of 420 deniers is used in this embodiment.

Furthermore, as the upper thread 1C, a thread made of a plurality of single yarns of 40 to 300 deniers and having a total thread thickness of 150 to 1100 deniers is preferably used, and a thread made of 3 single yarns of thickness of 166 deniers and having a total thread thickness of 498 deniers is used in this embodiment.

The FTY that constitutes the auxiliary thread 1D has a polyurethane yarn (spandex yarn) of thickness of 10 to 300 deniers, preferably 25 to 110 deniers, and more preferably 40 to 70 deniers used for its core yarn, and a polyester yarn or nylon yarn of thickness of 5 to 300 deniers, preferably 30 to 100 deniers, and more preferably 60 to 90 deniers used for its cover yarn. Specifically, for example, a polyurethane yarn of 70 deniers is used for the core yarn of the auxiliary thread 1D, and a nylon yarn of 70 deniers is used for the cover yarn.

The FTY that forms the under thread 1B has a polyurethane yarn of thickness of 10 to 300 deniers, preferably 30 to 100 deniers, and more preferably 40 to 80 deniers used for its core yarn, and a polyester yarn or nylon yarn of thickness of 5 to 300 deniers, preferably 45 to 150 deniers, and more preferably 70 to 100 deniers used for its cover yarn. Specifically, in this embodiment for example, a polyurethane yarn of 40 deniers is used for the core yarn, and a polyester yarn of 150 deniers is used for the cover yarn. Here, the reason for using a nylon yarn as the cover yarn is because, the nylon yarn has the property of causing, when subjected to a later-described heat setting treatment after woven into a sock, the knit structure to be contracted and substantially reduced in extensibility, after heat plasticization and subsequent cooling, with its form almost settled in a condition not to be affected by an external pressure.

After knitted into a predetermined sock with such a knit structure as mentioned above, the sock is subjected to the heat setting treatment. In this embodiment, the heat setting treatment includes applying steam under pressure of 0.5 atmospheric pressure (506.5 hPa) to 2.5 atmospheric pressure (2532.5 hPa), preferably 1.5 atmospheric pressure (1519.5 hPa) to 2.5 atmospheric pressure (2532.5 hPa), and more preferably 2.0 atmospheric pressure (2026 hPa) to 2.5 atmospheric pressure (2532.5 hPa), and heating for 40 to 90 seconds, and preferably 50 to 70 seconds with the temperature maintained at 125 to 150° C., and preferably 130 to 145° C. In this heat setting treatment, the temperature is higher (approximately 5 to 10° C. higher), the pressure is greater (approximately 0.5 atmospheric pressure (506.5 hPa) to 1 atmospheric pressure (1013 hPa) greater), and the processing time is longer (approximately 5 to 15 seconds longer) than those in an ordinary heat setting treatment for shaping socks. These differences are due to a difference in their objects.

When thus subjected to heat setting treatment, both front side and back side of the knitted fabric 10 having the auxiliary thread 1D and under thread 1B contracts and substantially decreases in extensibility. In other words, the knitted fabric 10 three-dimensionally contracts and decreases in extensibility. Stated differently, the knitted fabric 10 has surface stiffness. Moreover, the rubber thread 1A places the knitted fabric 10 in a contracted and extensibility-reduced condition.

According to the thus constructed sock A of the present embodiment, with the sock A being worn, the knitted fabric 10 at the inside half region 1*a* of the arch part 1 of the sock A and the lower part 5*u* of the inside surface 5 continuous thereto, is placed in a contracted and extensibility-reduced condition. As a result, due to the contractile action of the contractile knitted fabric (knit structure) at the part 1G of the ring-like part ranging circumferentially from the sole through the arch part 1 to the instep of the sock A which excludes the knitted fabric 10, the knitted fabric 10 possessing surface stiffness is drawn to the inside arch part of a sole and comes into close contact with (sticks fast to) the highly-sensitive-to-fit "inside site of the arch part" and the lower site of the foot side surface contiguous thereto at an appropriate pressure. For this reason, there can be obtained a sensuously high fit in addition to the above effects peculiar to the present invention. Furthermore, because the part 1G is knitted in a knit structure of high elasticity, a foot is not strongly compressed in a ring-like manner as with the conventional sock with a supporter effect. For this reason, if worn for a long period of time, the sock A does not cause blood congestion in the foot or unnecessary pressure on foot nerves, thereby letting the foot be free of tiredness. Furthermore, the sock A, like the conventional sock with a supporter effect, offers a fit, allows a foot to efficiently achieve a bodily balance, and makes it possible for impact force to be effectively absorbed at the inside arch part of the foot.

If the toe part 2 and the part 7 are lined with piles as in the sock A of the present embodiment, it is preferred for a sock for basketball and the like where the body weight is often supported on the toe part 2, from a point of view of alleviating impact force. In addition, in the case of the sock A, piles are also formed on the inner surface of a heel part 9, and thus the impact force that acts on the heel part of a foot on jumping and landing can be alleviated.

Moreover, in the case of the sock A, piles are formed at suitable intervals on the inner surface of the instep part 4 (vid. the corrugated bulge in FIGS. 1 and 2), and thus the influence of fastening a shoestring on the foot can be alleviated. Such a structure also makes a sock that is unlikely to cause tiredness and prevents blood congestion. If the sock A is thus formed on the inner surface of the instep part 4 with piles, it of course can alleviate the impact at the time of kicking a ball in soccer as well.

In the embodiment described hereinabove, description has been made with a relatively short, from-toe-to-ankle sock taken as an example, but the present invention is not restricted to the sock of this type, and may of course be applied to socks of the type which, like socks for soccer or baseball, extend higher than the ankle. Furthermore, needless to say, the present invention is also applicable to socks for other sports including jogging or the like.

Moreover, in the embodiment described hereinabove, if the color of the auxiliary thread 1D is made different from that of the under thread 1B or upper thread 1C, because the auxiliary thread 1D appears on the front side of the sock, a structure whereby a distinction can be easily made between a left and right sock that have different structures is obtained. Especially when the socks are of the ordinary type having a single pouched toe part 2, the above structure is preferred from the point of view of preventing a left and right sock from being worn conversely.

In the embodiment described hereinabove, although the knitted fabric 10 is formed only at the inside half region 1*a* of the arch art and the lower part 5*u* of the inside surface 5 contiguous thereto, the knitted fabric 10 may of course be formed all over the arch part 1.

The present invention is not restricted to the embodiment as described hereinabove, and may of course be put into practice in various altered forms within the same technical idea.

INDUSTRIAL APPLICABILITY

The present invention may be applied to socks that are produced by knitting a knitting yarn.

What is claimed is:

1. A sock having a length from a toe to at least an ankle and formed by knitting a knitting yarn, comprising:

a base knit structure knitted at least at an inside half region of a sole arch part of the sock from an upper thread and under thread;

an auxiliary thread further inserted along with the upper thread, and a knitted part thus formed which is contracted and reduced in extensibility, wherein said auxiliary thread comprises a FTY having a core yarn and cover yarn, said cover yam comprising a polyester yarn or nylon yarn, and wherein the sock is subjected to heat setting treatment after completion of knitting.

2. The sock according to claim 1, further comprising a rubber thread inserted as a knitting yarn for said inside half region of the sole arch part.

3. The sock according to claim 1, wherein said base knit structure at the inside half region of the sole arch part comprises ridge stitches, plain stitches, or mesh stitches.

4. The sock according to claim 1, wherein a thickness of said core yarn is from 25 deniers to 110 deniers, and a thickness of said cover yarn is from 5 deniers to 150 deniers.

5. The sock according to claim 1, wherein at least one of said core yarn and cover yarn is a yarn different in color from that of said upper thread.

6. The sock according to claim 1, wherein of a part ranging circumferentially from a sole through said arch part to an instep part, a part that excludes the arch part comprises ridge stitches, mesh stitches or plain stitches.

7. The sock according to claim 1, wherein said under thread comprises an FTY.

* * * * *